US007348490B2

(12) United States Patent
Sakai

(10) Patent No.: US 7,348,490 B2
(45) Date of Patent: Mar. 25, 2008

(54) DOUBLE WIRE CORD AND PORTABLE AUDIO DEVICE USING THE SAME

(75) Inventor: Kiyotaka Sakai, Tokyo (JP)

(73) Assignee: SDK Company, Tokyo (JP)

( * ) Notice: Subject to any disclaimer, the term of this patent is extended or adjusted under 35 U.S.C. 154(b) by 0 days.

(21) Appl. No.: 11/635,340

(22) Filed: Dec. 6, 2006

(65) Prior Publication Data

US 2007/0277995 A1 Dec. 6, 2007

(30) Foreign Application Priority Data

May 30, 2006 (JP) ..... 2006-150109

(51) Int. Cl.
*H01B 11/02* (2006.01)

(52) U.S. Cl. ..... 174/113 R; 174/115

(58) Field of Classification Search ..... 174/113 R, 174/115; 381/74, 309; 224/600
See application file for complete search history.

(56) References Cited

U.S. PATENT DOCUMENTS 6,639,152 B2 * 10/2003 Glew et al. ..... 174/113 C
6,751,382 B2 6/2004 McGarvey
2007/0080186 A1 * 4/2007 deLeon et al. ..... 224/600

FOREIGN PATENT DOCUMENTS

| | | |
|---|---|---|
| EP | 1 509 062 A1 | 2/2005 |
| JP | 07-211146 | 8/1995 |
| JP | 2004-056636 | 2/2004 |

* cited by examiner

*Primary Examiner*—Chau N. Nguyen
(74) *Attorney, Agent, or Firm*—Merchant & Gould P.C.

(57) ABSTRACT

A double wire cord is used in an electro-acoustic converter, such as earphones and headphones, and has a long first cord and a long second cord. For example, the first cord is substantially circular in cross section and has a large diameter, the second cord is also substantially circular in cross section and has a small diameter, and the second cord can be removably housed in the first cord. The second cord is fitted into the fitting groove of the first code and thus housed in the first cord by pressing the side surface of the second cord against the fitting groove of the first cord, so that one wire cord can be easily provided. Therefore, it is convenient at the time of use and storage.

5 Claims, 4 Drawing Sheets

DOUBLE WIRE CORD AND PORTABLE AUDIO DEVICE USING THE SAME

BACKGROUND OF THE INVENTION

1. Field of the Invention

The present invention relates to a double wire cord composed of a first cord and a second cord that can be separated from each other, and a portable audio device using the double wire cord, such as earphones and headphones.

2. Description of the Related Art

A conventional double wire cord that is composed of a pair of wire cords that can be separated from each other and used for stereo earphones, headphones or the like is described in Patent Documents 1-4.

In the Patent Document 1, a technique concerning stereo headphones using a double wire cord with a fastener is described. Each of the two headphone ear pieces for stereo is connected to one end of a corresponding one of the two wire cords, and the other ends of the wire cords are connected to a plug together.

The fastener is composed of a slider and two bands of tape that can be separated from each other by moving the slider. The two bands of tape of the faster are each formed into a sleeve, and each wire cord is passed through its corresponding sleeve, thereby forming the double wire cord with the fastener. Each of the two headphone earpieces is electrically connected to one end of a corresponding one of the two wire cords of the double wire cord with the fastener, and the other ends of the wire cords are fixed together with a clamp and electrically connected to a plug, thereby forming a set of headphones.

Since the wire cords of the headphones can be separated from each other by moving the slider, the length of the branched wire cords can be easily adjusted, and the wire cords can be conveniently housed without getting tangled.

As technology relevant to the patent document 1, the stereophonic earphone cable indicated by the patent documents 2-4 is also known. The stereophonic earphone cable is the technology about the cable in which combination or separation is possible.

However, in the double wire cord indicated by the conventional patent documents 1-4, since form and structure are complicated, mass production is difficult and becomes a cost overrun. In order to combine the double wire cord, it is necessary to unite the position of the joint part of two wire cords, and the slider for combination is needed if needed. Thereby, the number of parts increases , and mass production is difficult and becomes a cost overrun. In addition, when the double wire cord is combined, the form of the section of the combined whole double wire cord becomes large, and bending comes to be hard again. As a result, when bending was repeated by force to the combined double wire cord, there was a possibility that the two combined wire cords might dissociate mutually, and problems that it was hard to use occurred.

[Patent Document 1] Japanese Patent Laid-Open No. 2004-56636

[Patent Document 2] Japanese Patent Laid-Open No. 7-211146

[Patent Document 3] U.S. Pat/ No. 6,751,382

[Patent Document 4] European Patent Laid-Open No. 1,509,062

SUMMARY OF THE INVENTION

Even if a first object of the present invention does not prepare a coupling member, when a first cord and a second cord can be combined and separated easily and the first cord and the second cord are combined further, it is set to one wire cord and is to provide about a double wire cord with convenient use and storage.

A second object of the present invention is to provide by preparing a coupling member about a double wire cord to which the combination with a first cord and a second cord and separation becomes still easier.

When a first cord and a second cord are combined, a third object of the present invention is to provide about a double wire cord from which it does not separate easily, even if it bends and carries out the first cord and the second cord that were combined.

A fourth object of the present invention is to provide about a double wire cord which the section of a first cord and a second cord is made into simple form, and manufacture is made easy, and can make cost low.

A fifth object of the present invention is to provide a portable audio device that has a thin and simple wire cord portion and is convenient for use and storage.

In order to attain the first, third, and fourth objects described above, a double wire cord according to a first aspect of the present invention has a first cord and a second cord.

The first cord has a long first conductor, a first insulator coating the first conductor, a fitting groove having a recessed cross section formed in a side surface of the first insulator along the length of the first insulator, and elastic engaging parts formed on parts of the fitting groove. In addition, the second cord has a long second conductor and a second insulator that coats the second conductor and is detachably fitted into the fitting groove and locked by the engaging parts, the diameter of the cross section of the second cord being smaller than the diameter of the cross section of the fitting groove. The fitting groove having the recessed cross section has an opening having a predetermined width formed along the length of the side surface of the first insulator, for example. The engaging parts protrude from opposite parts of the opening in such directions that the engaging parts close the opening and provide a gap smaller than the diameter of the cross section of the second cord therebetween, for example.

According to the first aspect of the present invention configured as described above, the second cord is fitted into the fitting groove of the first code and thus housed in the first cord by pressing the side surface of the second cord against the fitting groove of the first cord, so that a double wire cord can be easily provided. In addition, the first cord and the second cord can be easily separated from each other by pulling the second cord housed in the fitting groove of the first cord apart from the fitting groove. In addition, since the first cord and the second cord have a simple structure, the first cord and second cord can be easily manufactured, have a high mass productivity and can be reduced in cost. Such a double wire cord having two cords capable of being fitted to or detached from each other can be used for various applications.

In order to attain the second objects described above, a double wire cord according to a second aspect of the present invention has the double wire cord according to the first aspect of the present invention and a coupling member.

The coupling member is fitted around the first and second cords in a slidable manner.

According to the second aspect of the present invention configured as described above, the first cord and the second cord can be coupled to each other at an arbitrary point by moving the coupling member. If the first cord and the second cord coupled to each other are pulled apart from each other, the coupling member moves accordingly, so that the first cord and the second cord can be easily separated from each other. In addition, a double wire cord having an arbitrary length can be easily provided by cutting the previously manufactured long first and second cords before use. In addition, since the double wire cord includes a reduced number of parts, the double wire cord can be easily manufactured, has a high mass productivity and can be reduced in cost. Such a double wire cord with the coupling member can be used for various applications.

In order to attain the fifth object described above, a portable audio device according to a third aspect of the present invention has the double wire cord according to the first or second aspect of the present invention, a pair of electro-acoustic converters connected to one end of the double wire cord, and a plug connected to the other end of the double wire cord. For example, the electro-acoustic converters are earphones or headphones.

According to the third aspect of the present invention configured described above, since the wire cord portion is constituted by the double wire cord having two cords capable of being coupled to/separated from each other, the wire cord portion can be thin and have a simple structure compared with those of conventional portable audio devices. In addition the length of the branch parts of the wire cord portion can be easily adjusted during use, and the portable audio device can be stored without the wire cord portion getting tangled.

These and other objects and novel characteristics of the present invention will be completely apparent from the following description of preferred embodiments with reference to the accompanying drawings. However, the drawings are given only for illustrative purposes and do not limit the scope of the present invention.

DETAILED DESCRIPTION OF THE PREFERRED EMBODIMENTS

In the following, embodiments of the present invention will be described with reference to the drawings.

First Embodiment (FIG. 1 to FIG. 4)

Figure 1:
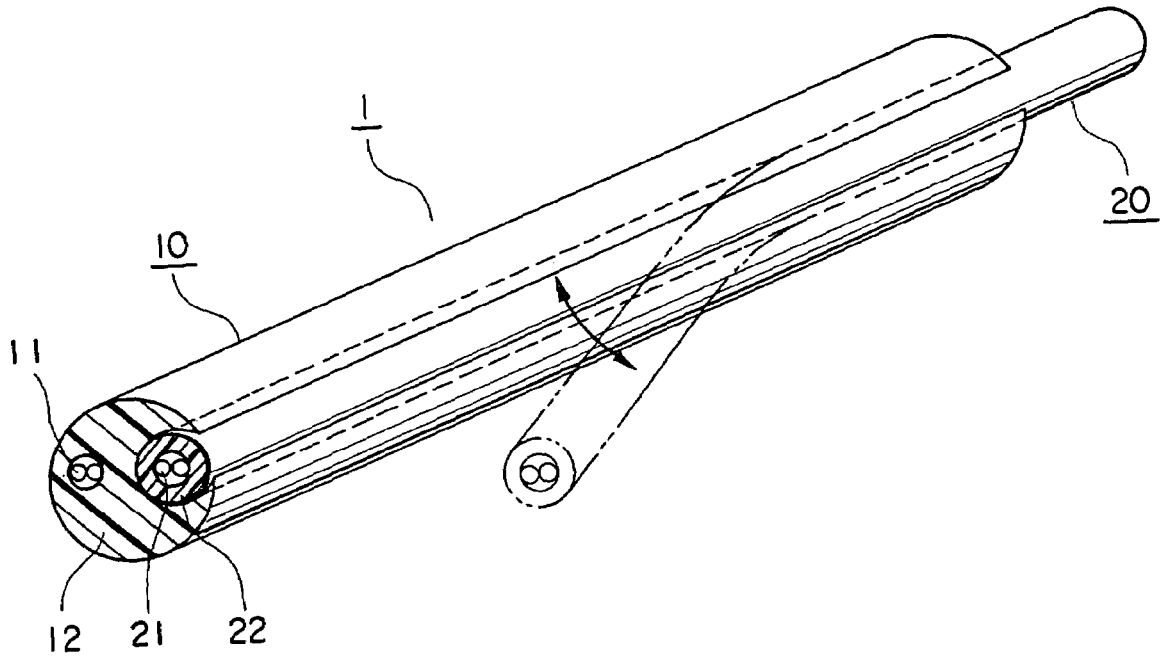
FIG. 1 is a schematic perspective view of a double wire cord according to a preferred first embodiment of the present invention.

A long double wire cord 1 shown in FIG. 1 has a long first cord 10 and a long second cord 20 that can be coupled to and separated from each other.

For example, the first cord 10 is substantially circular in cross section and has a large diameter, the second cord 20 is also substantially circular in cross section and has a small diameter, and the second cord 20 can be removably housed in the first cord 10.

The first cord 10 has a plurality of long first conductors 11 coated and insulated. The plurality of first conductors 11 are coated with a first insulator 12 that is substantially circular in cross section. The first insulator 12 has a fitting groove 14 having a recessed cross section (a substantially circular cross section having a diameter smaller than that of the insulator 12, for example) that is formed in the side surface along the length thereof. The fitting groove 14 has an opening 14*a* having a predetermined width and extending along the length of the insulator 12, and a pair of engaging parts 14*b* and 14*c* protrude from the opposite edges of the opening 14*a* in such directions that they close the opening 14*a* and provide a gap smaller than the diameter of the second cord 20 therebetween. The paired engaging parts 14*b* and 14*c* are elastic.

The first insulator 12, the fitting groove 14 and the engaging parts 14*b* and 14*c* are integrally made of a resin, such as non-vinylchloride. Although not shown, the plurality of first conductors 11 may be provided with one or more reinforcing threads extending along the first conductors 11.

The second cord 20 has a plurality of long second conductors 21 coated and insulated. The plurality of second conductors 21 are coated with a second insulator 22, which can be fitted into the fitting groove 14. The second insulator 22 is substantially circular in cross section, has a diameter slightly smaller than that of the diameter of the cross-section of the fitting groove 14, and is made of a resin, such as non-vinyl chloride. Although not shown, the plurality of second conductors 21 may be provided with one or more reinforcing threads extending along the second conductors 21.

Figure 3:
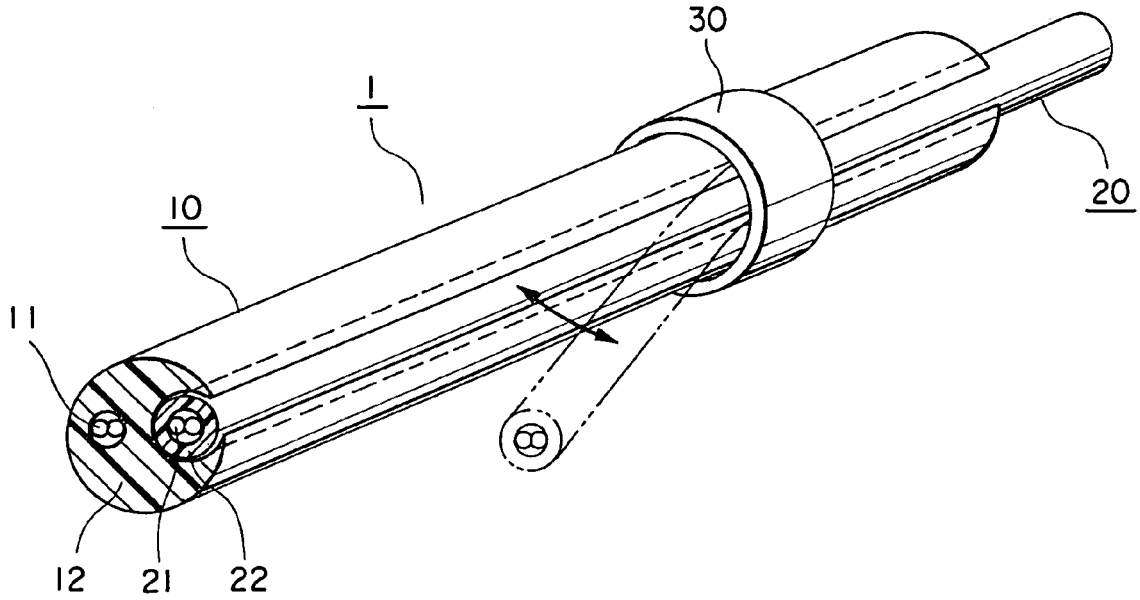
FIG. 3 is a schematic perspective view of the double wire cord with a coupling member according to the preferred first embodiment of the present invention.

As shown in FIG. 3, a coupling member (an annular member, for example) 30 may be fitted around the double wire cord 1 in a slidable manner.

The long double wire cord 1 according to the first embodiment is manufactured as described below, for example.

First, the long first cord 10 is manufactured. For example, the plurality of first conductors 11 (and the one or more reinforcing threads as required) are set in a crosshead of an extruder, and resin pellets for forming the coating member is supplied to the extruder. Then, the resin pellets are heated and made molten, and injected to the crosshead at a predetermined pressure, thereby coating the surface of the plurality of first conductors 11 (and the one or more reinforcing threads inserted as required) with the resin. The first conductors 11 (and the one or more reinforcing threads inserted as required) coated with the molten resin is drawn from the crosshead at a predetermined speed and cooled. In this way, the long first cord 10 is formed that has the first conductors 11 coated with the first insulator 12 having a predetermined cross section determined by the shape of the die at the outlet of the crosshead.

The second cord 20 is formed in the same manner as the first cord 10. The first cord 10 and the second cord 20 are set in a fitting device or the like, the longitudinal side surface of the second cord 20 is brought into contact with the fitting groove 14 formed in the side surface of the first cord 10 along the length thereof, and the second cord 20 is pressed to the fitting groove 14. Then, the second cord 20 is fitted into the fitting groove 14 and thus is housed in the first cord 10. Then, the double wire cord 1 comprising the first cord 10 and the second cord 20 housed in the first cord 10 is wound around a roller or the like, and the manufacture of the long double wire cord 1 is completed.

In the case where the annular member 30 is attached to the double wire cord 1, the completed double wire cord 1 can be inserted into the annular member 30.

Now, with reference to FIGS. 4(1) to 4(4), an operation of fitting/removing the second cord 20 into/from the first cord 10 will be described.

Figure 4:
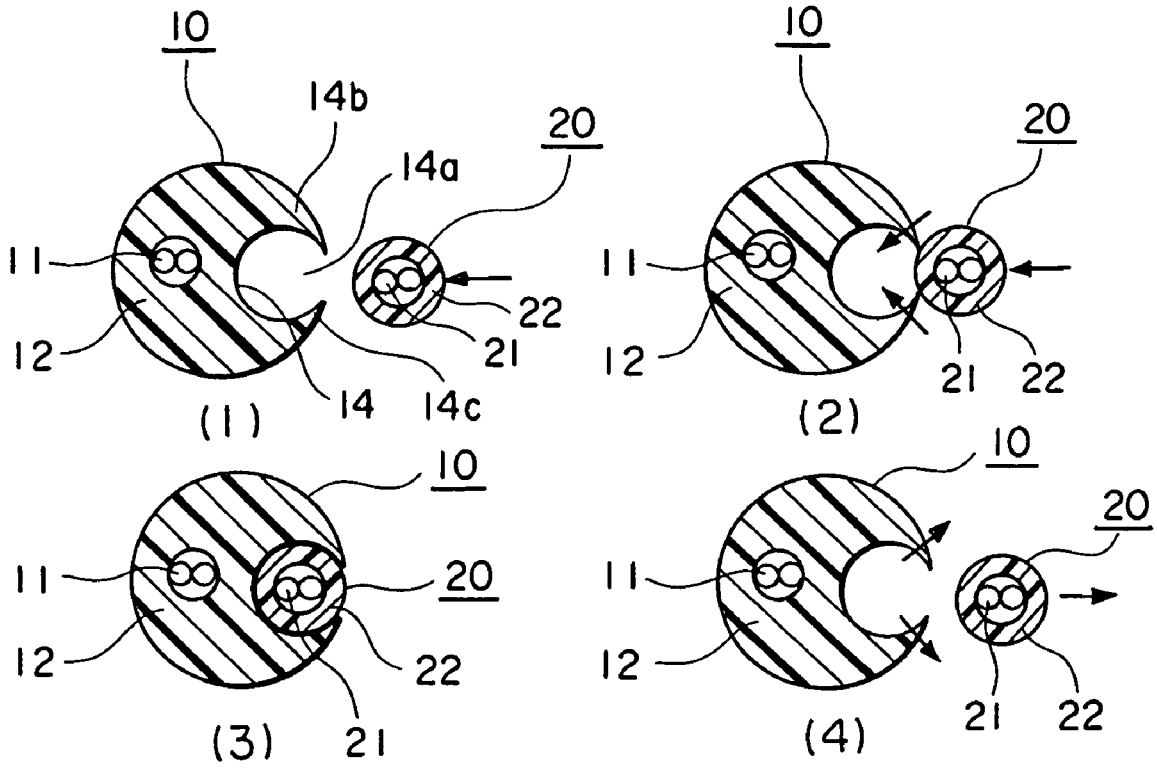
FIG. 4 includes cross-sectional views for illustrating fitting and separating operations of the double wire cord according to the preferred first embodiment of the present invention.

In the case where the second cord 20 is housed in the first cord 10, as shown in FIGS. 4(1) and 4(2), the longitudinal side surface of the second cord 20 is brought into contact with the opening 14*a* of the fitting groove 14 formed in the side surface of the first cord 10 along the length thereof, and the second cord 20 is pressed toward the inside of the fitting groove 14 as shown by the arrow in the drawings. In the case where the double wire cord 1 is provided with the annular member 30, the second cord 20 can be pressed toward the inside of the fitting groove 14 by sliding the annular member 30.

When the second cord 20 is pressed, the elastic engaging parts 14*b* and 14*c* at the edges of the opening 14*a* are bent by the side surface of the second cord 20 toward the inside of the fitting groove 14 as shown by the arrows in FIG. 4(2), and the second cord 20 is pressed into the opening 14*a* and fitted into the fitting groove 14. Thus, as shown in FIG. 4(3), the second cord 20 is housed in the first cord 10.

In the state where the second cord 20 is housed in the first cord 10, the engaging parts 14*b* and 14*c* of the first cord 10 engage with the side surface of the second cord 20, thereby preventing the second cord 20 from dropping off from the fitting groove 14. Thus, if the double cord 1 having the second cord 20 housed in the first cord 10 is bent, the second cord 20 does not drop off from the first cord 10.

When removing the second cord 20 from the first cord 10, as shown in FIG. 4(4), the second cord 20 in the first cord 10 is pulled toward the outside of the opening 14*a* as shown by the arrow in this drawing. In the case where the double wire cord 1 is provided with the annular member 30, the annular member 30 moves as the second cord 20 is pulled apart from the first cord 10. Then, the elastic engaging parts 14*b* and 14*c* are bent toward the outside as shown by the arrows in this drawing to widen the opening 14*a*, and the second cord 20 is removed from the fitting groove 14.

The double wire cord 1 according to the first embodiment has the following advantages (1) to (5).

(1) The first cord 10 with the fitting groove 14 having a larger diameter and the second cord 20 having a smaller diameter intended to be housed in the fitting groove 14 can be separated from or coupled to each other at an arbitrary point by pulling them apart from each other or pressing them against each other. In particular, since the fitting groove 14 has a substantially circular cross section, and the second cord 20 to be fitted into the fitting groove 14 also has a substantially circular cross section, no angular adjustment of the second cord 20 is required when fitting the second cord 20 into the fitting groove 14, so that the second cord 20 can be easily fitted into the fitting groove 14. In addition, once the second cord 20 is housed in the first cord 10, the doublewire cord 1 can be handled as one cord, which is convenient for use and storage.

(2) In the state where the second cord 20 is housed in the first cord 10, the second cord 20 is locked by the engaging parts 14*b* and 14*c* of the first cord 10. Therefore, even if the double wire cord 1 is bent, the second cord 20 does not drop off from the first cord 10.

(3) The first conductors 11 are coated with the first insulator 12, and the second conductors 21 are coated with the second insulator 22. Therefore, in the state where the second cord 20 is housed in the first cord 10, the electrical insulation between the first conductors 11 and the second conductors 21 is high.

(4) Since the first cord 10 has a large diameter, it has a high mechanical strength, such as tensile strength. Since the second cord 20 has a small diameter, it is light and easy to bend. Although the second cord 20 has a low mechanical strength, such as tensile strength, the second cord 20 is mechanically protected by the first cord 10 once the second cord 20 is housed in the first cord 10. Therefore, The double wire cord 1 can be used for various applications suitable for such characteristic thereof.

(5) Since the first cord 10 and the second cord 20 have simple form of a section, they are easy to manufacture and have high mass productivity, and the cost can be reduced.

Figure 5:
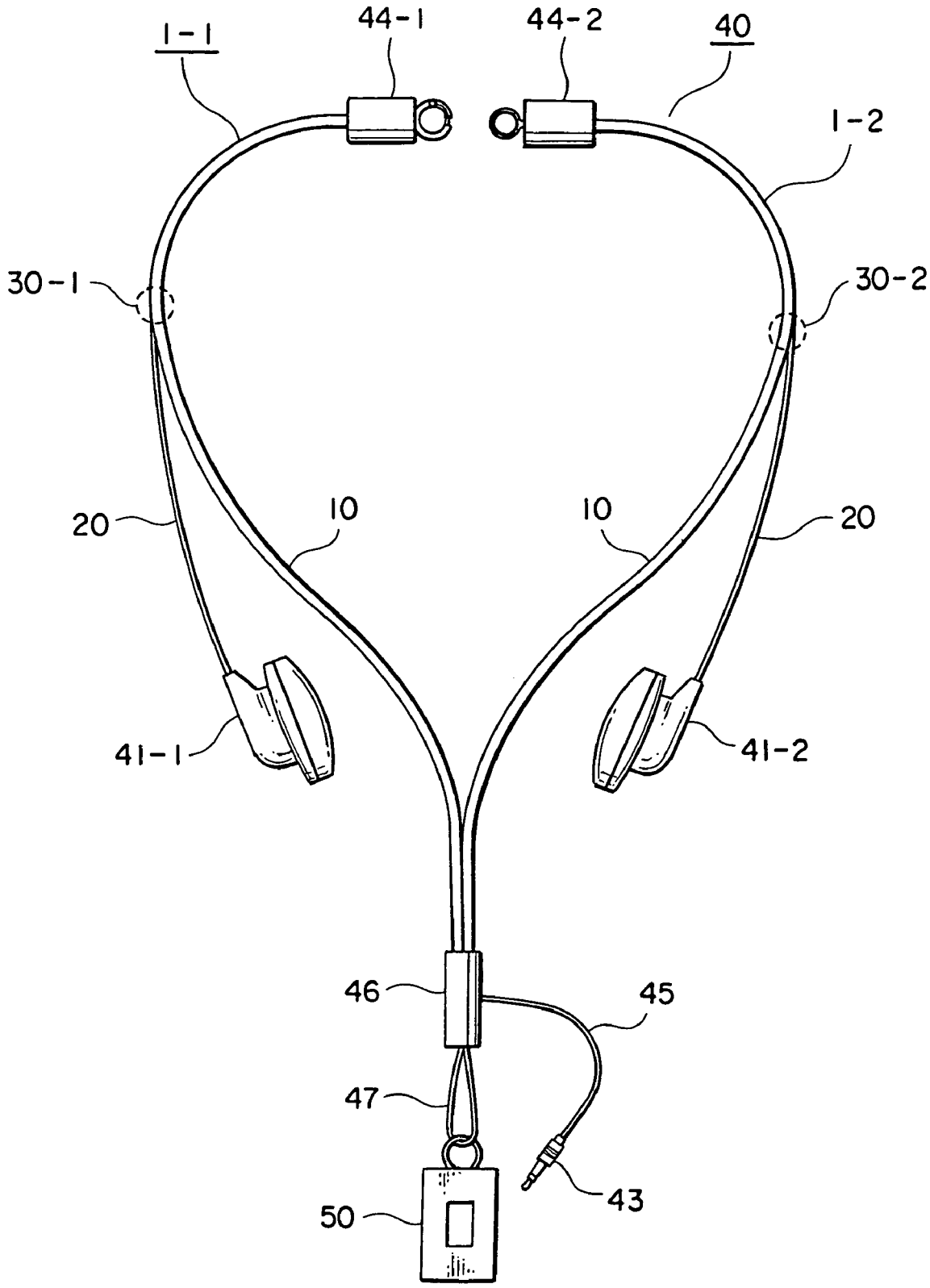
FIG. 5 is a schematic view of earphones according to a preferred second embodiment of the present invention.

Second Embodiment (FIG. 5)

A portable audio device (earphones, for example) 40 shown in FIG. 5 has the double wire cord 1 according to the first embodiment. In particular, according to the second embodiment, two double wire cords 1-1 and 1-2, each of which is the double wire cord 1, are used. At one end of one double wire cord 1-1, the first cord 10 and the second cord 20 of the double wire cord 1-1 are connected to each other, and a female coupling member 44-1 having the shape of a sleeve, for example, is attached to the double wire cord 1-1 to cover the connection. At the other end of the double wire cord 1-1, a stereo earpiece 41-1, which is an electro-acoustic converter, is connected to the second cord 20 of the double wire cord 1-1.

Similarly, at one end of the other double wire cord 1-2, the first cord 10 and the second cord 20 of the double wire cord 1-2 are connected to each other, and a male coupling member 44-2 having the shape of a sleeve, for example, is attached to the double wire cord 1-2 to cover the connection. The male coupling member 44-2 can be detachably coupled with the female coupling member 44-1 so that the double wire cords can be put around a neck. In addition, at the other end of the double wire cord 1-2, a stereo earpiece 41-2 is connected to the second cord 20 of the double wire cord 1-2.

At the other ends of the double wire cords 1-1 and 1-2, the first cord 10 of the double wire cord 1-1 and the first cord 10 of the double wire cord 1-2 are connected to one end of a short twin-core wire cord 45, and a fixing member 46 having the shape of a sleeve, for example, is attached to the first cords 10 to cover the connection thereof. The other end of the wire cord 45 is drawn from a hole in the side surface of the fixing member 46, for example, and connected to a plug 43. A ring-shaped thread 47, from which the portable audio device 50 can be suspended, is attached to the bottom of the fixing member 46, for example, and the plug 43 is inserted into a jack of the portable audio device 50.

Annular members 30-1 and 30-2, such as that shown in FIG. 3, may be fitted around the double wire cords 1-1 and 1-2 in a slidable manner. A method of using the earphones 40 according to the second embodiment will be described for the purpose of illustration.

When using the earphones 40, the thread 47 attached to the bottom of the fixing member 46 is fastened to a hook on the portable audio device 50. The plug 43 connected to the wire cord 45 drawn from the side surface of the fixing member 46 is inserted into a jack of the portable audio device 50. The double wire cords 1-1 and 1-2 coupled in a ring by the coupling members 44-1 and 44-2 are put around the neck, and the earpieces 41-1 and 41-2 connected to the branched second cords 20 and 20 of the double wire cords 1-1 and 1-2 are inserted into the ears.

In the case where the length of the each of the second cords 20 and 20 is to be adjusted, if the earpieces 41-1 and 41-2 connected to the branched second cords 20 and 20 are pulled outwardly, the second cords 20 and 20 are drawn from the fitting grooves 14 and 14 of the first cords 10 and 10, and thus, the length of each of the branched second cords 20 and 20 increases. At this time, if the annular members 30-1 and 30-2 are attached to the double wire cords 1-1 and 1-2, the annular members 30-1 and 30-2 slide vertically along the double wire cords 1-1 and 1-2, so that the length of each of the branched second cords 20 and 20 increases.

On the other hand, if the branched second cords 20 and 20 of the double wire cords 1-1 and 1-2 and their respective associated first cords 10 and 10 are pinched together with the fingers, and the fingers are slid downwardly, the branched second cords 20 and 20 are fitted into the fitting grooves 14 and 14 of the first cords 10 and 10, and thus, the length of each of the branched second cords 20 and 20 decreases. At this time, in the case where the annular members 30-1 and 30-2 are attached to the double wire cords 1-1 and 1-2, if the annular members 30-1 and 30-2 are pinched with the fingers and slid downwardly, the branched second cords 20 and 20 are fitted into the fitting grooves 14 and 14 of the first cords 10 and 10, and thus, the length of each of the second cords 20 and 20 decreases.

Sound signals output from the portable audio device 50 are transmitted through the plug 43, the wire cord 45, the first cords 10 and 10 of the double wire cords 1-1 and 1-2, and the second cords 20 and 20 of the double wire cords 1-1 and 1-2 to the ear pieces 41-1 and 41-2 and converted into sounds by the earpieces 41-1 and 41-2, and the sounds are perceived by the ears.

The earphones 40 according to the present invention has the following advantages (1) and (2).

(1) Since the double wire cords 1-1 and 1-2 having the first cord 10 and the second cord 20 that can be detachably coupled to each other, the cord portion can have a reduced thickness and a simple configuration, compared with conventional ones. In addition, in the case where the earphones 40 are used around the neck, the length of the branched second cords 20 and 20 is increased by pulling the branched second cords 20 and 20 outwardly, and the length of the branched second cords 20 and 20 is decreased by pinching the branches with the fingers and sliding the fingers downwardly or sliding the annular members 30-1 and 30-2 downwardly. Thus, the length of the branches can be conveniently easily adjusted. In addition, since the branched second cords 20 and 20 can be housed in the first cords 10 and 10, the earphones 40 can be stored without the cord portion getting tangled.

(2) In the case where the double wire cords 1-1 and 1-2 coupled in a ring by the coupling members 44-1 and 44-2 are put around the neck, and the earpieces 41-land 41-2 are inserted into the ears during use, the weight of the hanging portable audio device 50 is applied to the neck via the first cords 10 and 10 having a larger diameter and a higher mechanical strength, and no direct tension is applied to the earpieces 41-1 and 41-2 connected to the second cords 20 and 20 having a smaller diameter and a lighter weight. Therefore, the earpieces 41-1 and 41-2 are less likely to drop off from the ears and are less fatiguing for the ears.

The present invention is not limited the first and second embodiments described above, and various modifications can be made. For example, the following modifications (a) to (c) are possible.

(a) In the first embodiment, the cross sections of the first cord 10 and the second cord 20 can have various shapes and configurations other than those shown in FIG. 1. For example, while the cross sections of the first insulator 12, the fitting groove 14 and the second insulator 22 shown in FIG. 1 are substantially circular, they can have other shapes, such as a substantially elliptical shape and a substantially rectangular shape.

Figure 2:
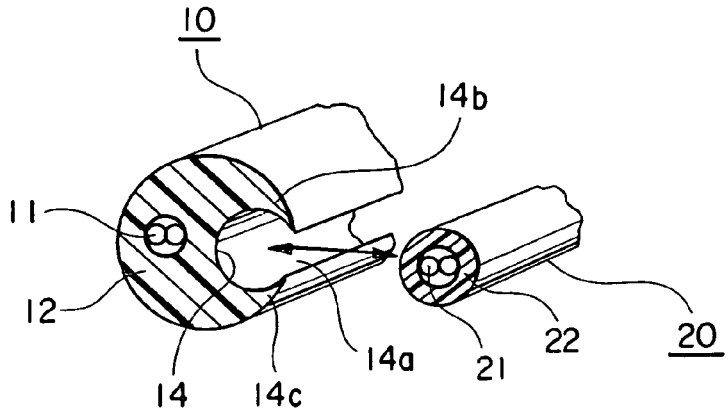
FIG. 2 is a perspective view of an end part of the double wire cord shown in FIG. 1 according to the preferred first embodiment of the present invention.

(b) In the first embodiment, the engaging parts 14*b* and 14*c* shown in FIG. 2 have a sharp tip in cross section. The sharp tip can be slightly bent inward or slightly rounded to facilitate fitting of the second cord 20 into the first cord 10 when housing the second cord 20 in the first cord 10. (c) With regard to the second embodiment, the earphones 40 have been described as exemplary applications of the double wire cords according to the first embodiment. However, the present invention can be applied to other portable audio devices, such as headphone, and other various devices.

The invention claimed is:

1. A double wire cord, comprising:

a first cord that has a long first conductor, a first insulator coating said first conductor, a fitting groove having a recessed cross section formed in a side surface of said first insulator along the length of said first insulator, and elastic engaging parts formed on parts of said fitting groove; and a second cord that has a long second conductor and a second insulator that coats said second conductor and is detachably fitted into said fitting groove and locked by said engaging parts, the diameter of the cross section of the second cord being smaller than the diameter of the cross section of said fitting groove.

2. The double wire cord according to claim 1, further comprising:

a coupling member that is fitted around said first and second cords in a slidable manner.

3. The double wire cord according to claim 1, wherein said fitting groove having the recessed cross section has an opening having a predetermined width formed along the length of the side surface of said first insulator, and said engaging parts protrude from opposite parts of said opening in such directions that the engaging parts close said opening and provide a gap smaller than the diameter of the cross section of said second cord therebetween.

4. A portable audio device, comprising:

a double wire cord according to claim 1;

a pair of electro-acoustic converters connected to one end of said double wire cord; and a plug connected to the other end of said double wire cord.

5. The portable audio device according to claim 4, wherein said electro-acoustic converters are earphones or headphones.

* * * * *

UNITED STATES PATENT AND TRADEMARK OFFICE

CERTIFICATE OF CORRECTION

PATENT NO. : 7,348,490 B2
APPLICATION NO. : 11/635340
DATED : March 25, 2008
INVENTOR(S) : Sakai It is certified that error appears in the above-identified patent and that said Letters Patent is hereby corrected as shown below:

Col. 8, line 30, claim 1: "first conductor, a first" should read --first conductor, a first reinforcing thread extending along said first conductor, a first--

Col. 8, line 31, claim 1: "first conductor, a fitting" should read --first conductor and said first reinforcing thread, a fitting--

Col. 8, line 36, claim 1: "second conductor and a" should read --second conductor, a second reinforcing thread extending along said second conductor and a--

Col. 8, lines 37-38, claim 1: "conductor and is detachably" should read --conductor and said second reinforcing thread and is detachably--

Signed and Sealed this

Twenty-ninth Day of July, 2008

JON W. DUDAS
*Director of the United States Patent and Trademark Office*